US009151530B2

(12) United States Patent
Tanaka et al.

(10) Patent No.: US 9,151,530 B2
(45) Date of Patent: Oct. 6, 2015

(54) AUTOMATIC ICEMAKER

(75) Inventors: Mariko Tanaka, Gumma (JP); Kenji Sugaya, Gumma (JP); Kazufumi Yamashita, Gumma (JP); Yoshitaka Yokoi, Gumma (JP); Saburo Niwa, Gumma (JP); Eiji Kuroda, Gumma (JP)

(73) Assignee: Nidec Servo Corporation, Gumma (JP)

( * ) Notice: Subject to any disclaimer, the term of this patent is extended or adjusted under 35 U.S.C. 154(b) by 931 days.

(21) Appl. No.: 13/304,883

(22) Filed: Nov. 28, 2011

(65) Prior Publication Data

US 2012/0297802 A1 Nov. 29, 2012

(30) Foreign Application Priority Data

Nov. 29, 2010 (JP) ..... 2010-265406

(51) Int. Cl.
*F25B 49/00* (2006.01)
*G01K 13/00* (2006.01)
*F25C 5/18* (2006.01)

(52) U.S. Cl.
CPC ..... *F25C 5/187* (2013.01)

(58) Field of Classification Search
CPC ..... F25C 5/00; F25C 5/18; F25C 5/182
USPC ..... 29/890.035; 62/125, 126, 129, 130, 62/131, 135, 137, 139, 267, 298, 300, 62/301; 222/146.6
See application file for complete search history.

(56) References Cited

U.S. PATENT DOCUMENTS

| | | | | |
|---|---|---|---|---|
| 3,871,242 | A * | 3/1975 | Linstromberg | 74/421 A |
| 5,010,738 | A | 4/1991 | Brown et al. | |
| 5,881,563 | A | 3/1999 | Lee et al. | |
| 6,299,026 | B1 * | 10/2001 | Jaleel et al. | 222/146.6 |
| 6,427,456 | B2 * | 8/2002 | Niwa et al. | 62/137 |
| 7,748,231 | B2 * | 7/2010 | Chung | 62/344 |
| 7,770,404 | B2 * | 8/2010 | An et al. | 62/137 |
| 7,958,918 | B2 * | 6/2011 | Ladson | 141/114 |
| 2005/0056032 | A1 * | 3/2005 | Kim et al. | 62/126 |
| 2005/0257536 | A1 * | 11/2005 | Chung et al. | 62/135 |
| 2007/0220909 | A1 * | 9/2007 | An et al. | 62/137 |
| 2008/0256962 | A1 * | 10/2008 | Lee et al. | 62/137 |
| 2009/0255282 | A1 * | 10/2009 | Amonett et al. | 62/137 |
| 2010/0212340 | A1 * | 8/2010 | Kuratani | 62/137 |

* cited by examiner

*Primary Examiner* — M. Alexandra Elve
*Assistant Examiner* — Henry Crenshaw
(74) *Attorney, Agent, or Firm* — Keating & Bennett, LLP

(57) ABSTRACT

An automatic icemaker includes a swing arm, an actuator swinging the swing arm, and a transmission section transmitting movement of the actuator to the swing arm. The transmission section includes a cam rotated by the actuator, a pivotally movable lever including an abutting portion abutting the cam and pivotally moved by the rotation of the cam, and a joint member to transmit the movement of the pivotally movable lever to the swing arm. As the swing arm, one of the first, second, and third swing arms is selected and provided. As the joint member, one of the first, second, and third joint members which corresponds to the selected one of the first, second, and third swing arms is selected and provided. At different positions on a board which extends in a vertical direction, the first, second, and third supporting portions support the first, second, and third joint members, respectively.

4 Claims, 7 Drawing Sheets

AUTOMATIC ICEMAKER

BACKGROUND OF THE INVENTION

1. Field of the Invention

The present invention relates to an automatic icemaker provided in a refrigerator that is arranged to repeatedly and automatically make ice.

2. Description of the Related Art

In general, an automatic icemaker supplies water to an ice tray to make ice, and then drops the ice made within the ice tray into an ice reservoir arranged under the ice tray by means of an ice discharge device. The ice discharge device is arranged to drop the ice in the ice tray into the ice reservoir by turning over the ice tray or scraping out the ice from the ice tray by an ice discharge lever, for example. Then, steps of supplying water, ice making, and discharging ice are repeated.

The above automatic icemaker is provided with an ice level detection device for detecting that the ice level in the ice reservoir is at a predetermined level (typically, a level close to a full level) or higher. When the ice level is detected to be the predetermined level or higher by the ice level detection device, discharging ice is stopped thereafter.

The ice level detection device typically includes a swing arm arranged to swing or pivotally move around a predetermined axis, an actuator arranged to drive the swing arm to swing, and a transmission section arranged to transmit the movement of the actuator to the swing arm. When the swing movement of the swing arm is stopped, i.e., the swing arm has become immovable because of the ice in the ice reservoir, the ice level detection device detects that the ice level in the ice reservoir is at the predetermined level or higher.

Conventional ice level detection techniques using swing arms are roughly classified into three types. In the first one, as described in U.S. Pat. No. 6,427,456, for example, the first swing arm is provided to swing in a horizontal plane which passes between the ice tray and the ice reservoir around a vertical first axis. In the second technique, as described in U.S. Pat. No. 5,881,563, for example, the second swing arm is provided to swing in a vertical plane passing inside the ice reservoir and outside the ice tray, around a horizontal second axis. In the third technique, as described in U.S. Pat. No. 5,010,738, for example, the third swing arm is provided to swing along a cylindrical surface which is arranged around a horizontal third axis as a center and passes outside the ice tray and inside the ice reservoir, around that third axis. One of those three techniques is selected in accordance with the layout of the inside of the refrigerator, the specification of the ice reservoir, and the like.

In case of manufacturing an automatic ice maker, however, the arrangement and operation of the swing arm are different among the ice level detection techniques and it is therefore necessary to design and manufacture an ice level detection device depending on the selected ice level detection method. This is uneconomical.

SUMMARY OF THE INVENTION

Preferred embodiments of the present invention are arranged to share components usable in three different ice level detection techniques as much as possible and to, in a case where the ice level detection technique is changed, enable easy manufacturing of an ice level detection device which can easily deal with changes in the ice level detection technique only by replacing a few components.

According to a preferred embodiment of the present invention, an automatic icemaker preferably includes an ice tray arranged to be supplied with water and arranged to make ice; an ice discharge device arranged to make the ice made by the ice tray fall off into an ice reservoir arranged below the ice tray; and an ice-level detection device arranged to detect that an ice level in the ice reservoir is at a predetermined level or higher. A board is provided on an outer side surface of the ice tray and arranged to extend in a vertical direction. The ice-level detection device preferably includes a swing arm supported by the board to be capable of swinging and arranged not to swing when the ice level in the ice reservoir is at the predetermined level or higher; an actuator arranged to be supported by the board and arranged to drive the swing arm such that the swing arm will swing; and a transmission section arranged to be supported by the board and arranged to transmit movement of the actuator to the swing arm. The swing arm, the actuator, and the transmission section are all arranged to be supported on the board. The transmission section preferably includes a cam arranged to be rotated by the actuator, a pivotally movable lever including an abutting portion arranged to abut the cam and being pivotally moved by rotation of the cam, and a joint member connected to the swing arm and arranged to transmit pivotal movement of the pivotally movable lever to the swing arm. The swing arm is one selected from a first swing arm, a second arm, and a third arm. The first swing arm is arranged to swing in a horizontal plane passing between the ice tray and the ice reservoir around a vertical first axis. The second swing arm is arranged to swing in a vertical plane passing outside the ice tray and inside the ice reservoir, around a horizontal second axis which is approximately along a surface of the board. The third swing arm is arranged to swing along a cylindrical surface, which passes outside the ice tray and inside the ice reservoir and is arranged around a horizontal third axis perpendicular or substantially perpendicular to the surface of the board, around the third axis. The joint member is one of a first joint member arranged to be connected to the first swing arm, a second joint member arranged to be connected to the second swing arm, and a third joint member arranged to be connected to the third swing arm, which is selected to correspond to the selected one of the first swing arm, the second swing arm, and the third swing arm. The swing arm is arranged to be supported by the board via the joint member. First, second, and third supporting portions are provided on the board, at positions different from one another to support the first, second, and third joint members, respectively.

According to the above structure, it is only necessary to change the joint member to correspond to the selected swing arm. Moreover, the board is provided with the first, second, and third supporting portions arranged to respectively support the first, second, and third joint members. Thus, it is only necessary to arrange the joint member corresponding to the selected swing arm to be supported by one of the supporting portions corresponding thereto. Therefore, many components can be shared among three ice-level detection methods and therefore the component cost can be reduced. Also, it is possible to promptly manufacture the automatic icemaker to correspond to the selected ice-level detection method.

According to the automatic icemaker of various preferred embodiments of the present invention, it is possible to share as many components as possible across three ice-level detection techniques and, even if the ice level detection technique is changed, it is possible to easily obtain the ice-level detection device which can deal with the change by replacing only a few components.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
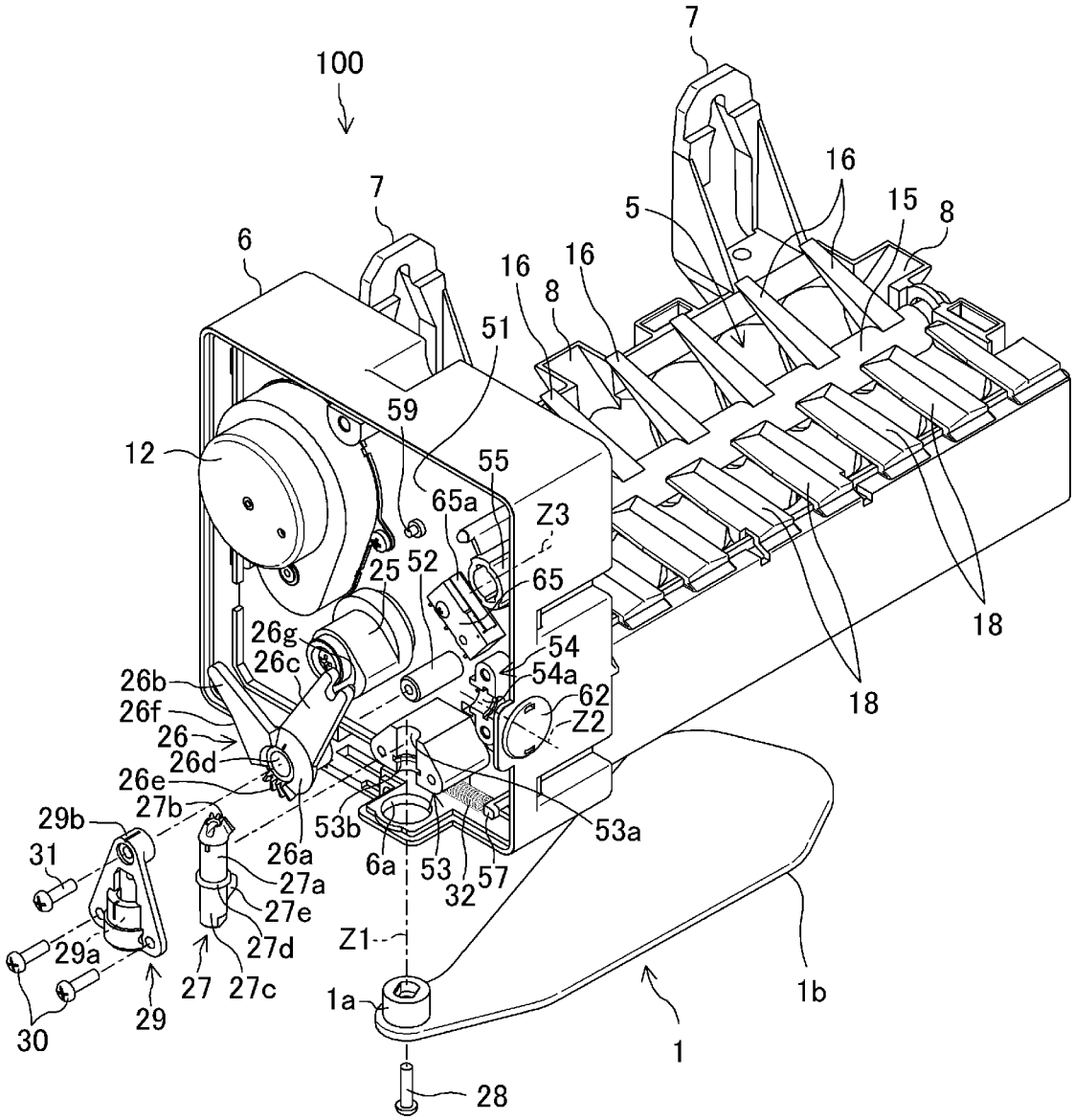
FIG. 1 is a perspective view of an automatic icemaker according to a preferred embodiment of the present invention, in which a first swing arm is provided.

An automatic icemaker 100 according to a preferred embodiment of the present invention is arranged to be installed in a refrigerator, and includes any one of the first swing arm 1 (shown in FIGS. 1 and 2), the second swing arm 2 (shown in FIGS. 3 and 4), and the third swing arm 3 (shown in FIGS. 5, 6 and 7) as a swing arm of an ice level detection device arranged to detect that the ice level in an ice reservoir 21 (shown in FIGS. 2, 4 and 6) is at a predetermined level or higher.

Figure 2:
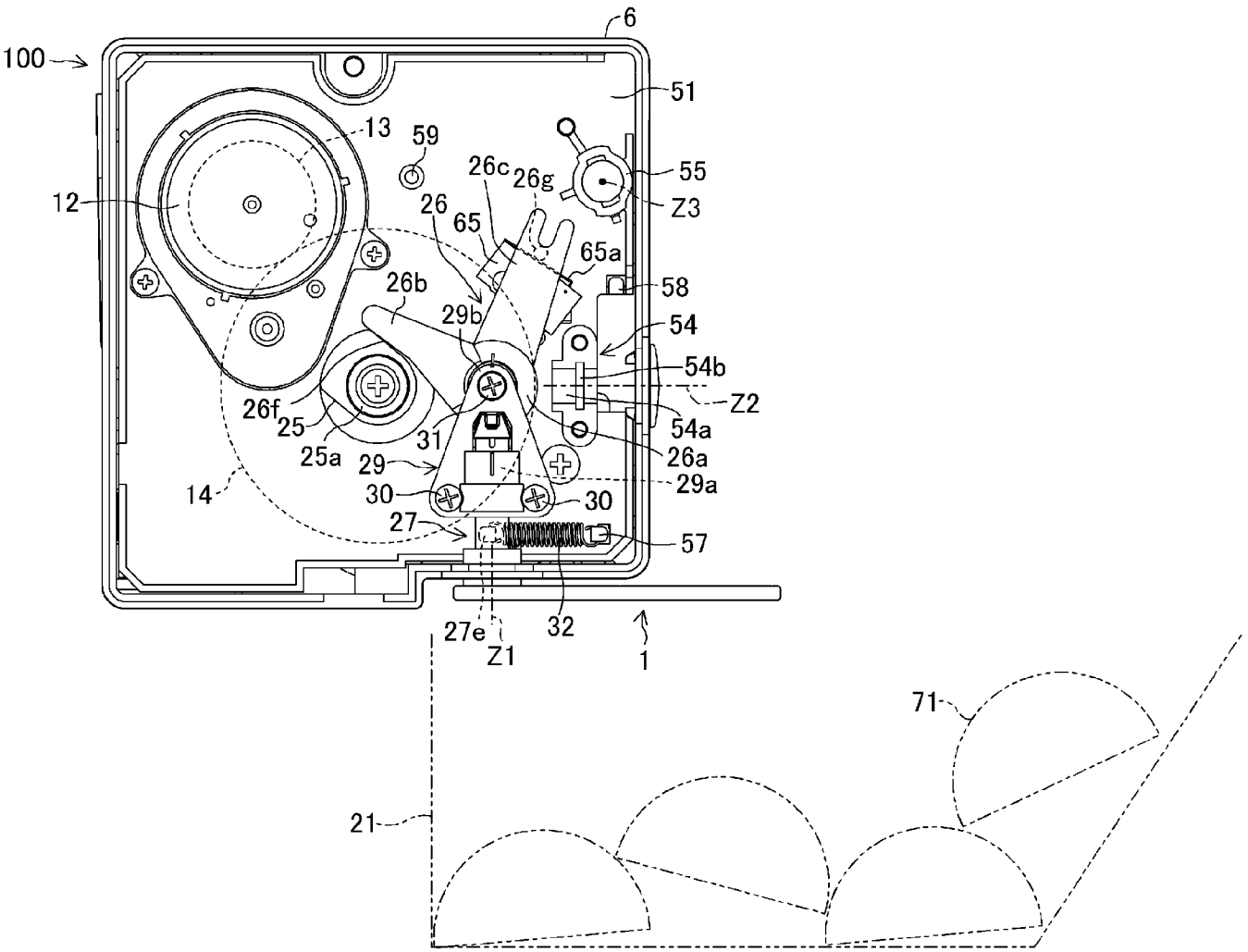
FIG. 2 shows the inside of a case of the automatic icemaker of FIG. 1.

FIGS. 1 and 2 show a case where the first swing arm 1 is provided in the automatic ice maker 100. The automatic icemaker 100 includes an ice tray 5 arranged to make ice. This ice tray 5 is approximately rectangular when seen from above. On an outer side surface of the ice tray 5 (an outer side surface of the ice tray 5 at one end thereof in the lengthwise direction in this preferred embodiment), a case 6 in the shape of a substantially rectangular box is provided. In the case 6, a motor 12 arranged as an actuator of the ice level detection device (also serving as an actuator of an ice discharge device described later) and a transmission section are accommodated Hereinafter, the side of the automatic icemaker 100 on which the case 6 is provided is referred to as a front side and the opposite side is referred to as a rear side. Also, the left side and the right side of the automatic icemaker 100 when seen from the front side are referred to as a left side and a right side, respectively. Therefore, the lengthwise direction of the ice tray 5 is the back-front direction and the lateral (widthwise) direction is the left-right direction.

Inside the ice tray 5 is separated into a plurality of compartments, although not shown. In this preferred embodiment, it is preferable that seven compartments are arranged in the back-front direction, but any other desirable number of compartments could be used. Each compartment is open towards the above and has an approximately arc-shaped bottom surface when seen from the front, so that the compartment is concave. In those compartments, ice blocks 71 (see FIG. 2) having the shape corresponding to the compartments are made, respectively.

On the left outer side surface of the ice tray 5, mounting legs 7 arranged to fix the ice tray 5 to the wall inside the refrigerator are fixed at the front and rear ends of the ice tray 5. Moreover, on the left side surface and rear side surface of the ice tray 5, water supply inlets 8 are arranged to supply water to the ice tray 5. Water is supplied to either one of the water supply inlets 8 from a water tank (not shown) which is installed in the refrigerator. As described above, two water supply inlets 8 are provided in the automatic icemaker of this preferred embodiment and either one of them is selectively used depending on the installed locations of the water tank and ice tray 5 in the refrigerator. After the ice blocks 71 are discharged from the ice tray 5 in the manner described later, a predetermined amount of water is supplied to the ice tray 5 (to each compartment) from the water tank via the water inlet 8. The water supplied to the ice tray 5 freezes because of a cold air inside the refrigerator (freezer) in which the ice tray 5 is arranged. In this manner, ice making is carried out in the ice tray 5.

The case 6 preferably has a structure in which it is divided in two in the back-front direction. In FIGS. 1 and 2, the front portion of the case 6 is omitted for showing the inside of the case 6. Around the center of the case 6 in the back-front direction, a board 51 extending vertically (and in the left-right direction) is provided to divide the inside of the case 6 into two portions arranged in the back-front direction. The board 51 is preferably provided on the front outer side surface of the ice tray 5 via the case 6.

On the front surface of the board 51, a motor 12 is supported in a left upper portion. The motor shaft of the motor 12 runs through the board 51 in the back-front direction and protrudes backward. To the motor shaft, a driving gear 13 (see FIG. 2) is fixed so that it can rotate together with the motor shaft. The driving gear 13 is located on the back side of the board 51. On the back side of the board 51, a driven gear 14 (see FIG. 2) is also provided to mesh with the driving gear 13. The driven gear 14 is coaxially connected to the front end of an ice-discharge lever shaft 15 extending in the back-front direction around the center in the left-right direction in an upper portion of the ice tray 5.

The ice-discharge lever shaft 15 is supported at the rear end of the case 6 and the ice tray 5 to be rotatable, and can rotate about a center axis of the ice-discharge lever shaft 15 together with the driven gear 14 as one unit. On the outer circumferential surface of the ice-discharge lever shaft 15, a plurality of ice-discharge levers 16 are fixed at positions in the back-front direction corresponding to the compartments arranged in the back-front direction. In this preferred embodiment, seven ice-discharge levers 16 are provided, though any other desirable number of ice-discharge levers 16 can be provided. When the motor 12 is driven and the driven gear 14 is rotated via the driving gear 13, the ice-discharge lever shaft 15 is arranged to simultaneously rotate around its center axis, thereby rotating the ice-discharge levers 16 around the center axis of the ice-discharge lever shaft 15. Because of this rotation of the ice-discharge levers 16 the ice blocks 71 made in the ice tray 5 (in the respective compartments) are scraped out, as described later. At the same time as the rotation of the ice-discharge levers 16, the ice tray 5 is heated by a heater (not shown) which is turned on. This heating makes it possible for the ice blocks 71 to be peeled off from the walls of the respective compartments.

In the shown example, the ice-discharge lever shaft 15 and the ice-discharge levers 16 rotate in the clockwise direction when seen from the front side. By this rotation, each ice-discharge lever 16 pushes the right end of the top surface of the ice block in the corresponding compartment downward. If peeling of the ice block has not finished yet, the ice-discharge lever 16 continues to push the top surface of the ice block. When the ice block 71 peels off, it goes out from the left portion thereof upwardly of the ice tray 5 as the ice-discharge lever 16 rotates. Then, when the ice-discharge lever 16 has made one revolution, the entire ice block in the corresponding compartment has been pushed up to the upper portion of the ice tray 5. Thereafter, the second revolution of the ice-discharge lever 16 moves the ice block 71 thus pushed up to the right. The ice block 71 then slides on a top plate 18 provided on the right upper portion of each compartment and falls off from the right end of the top plate 18. The top plate 18 on the right upper portion of each compartment is arranged at both ends of the compartment in the back-front direction so that it does not prevent the rotation of the corresponding ice-discharge lever 16.

Below the ice tray 5, an ice reservoir 21 is arranged so that it opens upward. The ice blocks 71 caused to fall off by the ice-discharge levers 16 are received by and accommodated in the ice reservoir 21. The upper opening of the ice reservoir 21 extends to the right in order to surely and reliably receive the ice blocks 71 falling off from the right end of the top plates 18. Moreover, for the reason related to ice level detection by the first swing arm 1, the ice reservoir 21 is arranged more to the right with respect to the ice tray 5, as compared with a case where the second or third swing arm is provided. It should be noted that the shape and position of the ice reservoir 21 in this preferred embodiment are merely examples, but are not limited thereto.

The motor 12, the driving gear 13, the driven gear 14, the ice discharge lever shaft 15, and the ice discharge levers 16 preferably define an ice discharge device which make the ice blocks 71 made in the ice tray 5 fall into the ice reservoir 21 arranged below the ice tray 5. The motor 12, the driving gear 13, and the driven gear 14 are also components of the ice level detection device which will be described later.

The driven gear 14 is also connected to a cam shaft 25*a* of a cam 25 arranged on the front side of the board 51 coaxially or substantially coaxially. The cam shaft 25*a* is arranged to extend through the board 51 in the back-front direction. At the front end of the cam shaft 25*a*, the cam 25 is connected to be rotatable together with the cam shaft 25*a* as one unit. At the rear end of the cam shaft 25*a*, the driven gear 14 is connected to be rotatable together with the cam shaft 25*a* as one unit. The cam shaft 25*a* is supported by the board 51 to be rotatable, thereby the cam 25 is supported by the board 51 to be rotatable. When the motor 12 is driven and the driven gear 14 is rotated via the driving gear 13, the cam 25 also rotates together with the ice-discharge lever shaft 15.

On the right side of the cam 25 (the cam shaft 25*a*) on the front surface of the board 51, a first pivotally movable lever 26 is supported to be pivotally movable. The first pivotally movable lever 26 includes a tube-shaped supporting portion 26*a* which extends in the back-front direction and is provided with a fitting hole 26*d*, and first and second extending portions 26*b* and 26*c* which radially extend from the front end of the supporting portion 26*a* approximately along the front surface of the board 51. The fitting hole 26*d* is arranged so that the lever supporting shaft 52 extending forward from the front surface of the board 51 is fitted thereinto. The first extending portion 26*b* extends to the above of the cam 25, and the second extending portion 26*c* extends towards a tube-shaped supporting portion 55 described later. Also, a gear portion 26*e* is provided in a portion of the circumference of the front end of the supporting portion 26*a* (in a portion near the first extending portion 26*b*).

The side surface of the first extending portion 26*b* on the cam 25 side defines an abutting portion 26*f* which is arranged to abut the cam 25. On the rear surface of the second extending portion 26*c*, a switch operating portion 26*g* defined by a pin arranged to activate a micro switch 65 is provided near the top end of the second extending portion 26*c*. The switch operating portion 26*g* protrudes backward. While the first pivotally movable lever 26 is in an initial state (shown in FIG. 2), a switch piece 65*a* of the micro switch 65, in the form of a cantilever, is being pressed by the switch operating portion 26*g* and therefore the micro switch 65 is in ON state.

The first pivotally movable lever 26 is biased by a first return spring 32 described later to pivotally move around the lever supporting shaft 52 in the counterclockwise direction in FIG. 2. Because of this, the abutting portion 26*f* of the first pivotally movable lever 26 abuts the cam 25. When the cam 25 is at an initial rotational position shown in FIG. 2, the first pivotally movable lever 26 is in the initial state. Then, the cam 25 pivotally moves in the clockwise direction from the initial rotational position shown in FIG. 2 at the same time as the revolution of the ice-discharge lever shaft 15, thereby the first pivotally rotatable lever 26 pivotally moves around the lever supporting shaft 52 from the aforementioned initial state. During the first half of one revolution of the cam 25, the first pivotally movable lever 26 pivotally moves in the clockwise direction in FIG. 2 because the first extending portion 26*b* of the first pivotally movable lever 26 is pushed up by a larger-diameter portion of the cam 25. When the first pivotally movable lever 26 pivotally moves from the initial state in the clockwise direction slightly, the micro switch 65 is turned off. Then, after the larger-diameter portion of the cam 25 passed through the position at which it causes the first pivotally movable lever 26 to pivotally move from the initial state in the clockwise direction maximally, the first pivotally movable lever 26 pivotally moves in the counterclockwise direction because of the first return spring 32 with following the cam 25. When the cam 25 returns to the initial rotational position after one revolution, the first pivotally movable lever 26 returns to the initial state and the micro switch 65 is turned on.

The pivotal movement of the first pivotally movable lever 26 is transmitted to the first swing arm 1 via a first joint member 27. The first swing arm 1 (a detection portion 1*b* described later) is arranged to swing in a horizontal plane passing between the ice tray 5 and the ice reservoir 21 around a vertical first axis Z1. The first swing arm 1 includes a connecting portion 1*a* which defines the surrounding of the first axis Z1 as the swing center and is connected to the first joint member 27, and the detection portion 1*b* in the form of a plate which is fixed to the lower end of the connecting portion 1*a* and extends backward from the connecting portion 1*a*. The detection portion 1*b* extends in the back-front direction and the right-left direction in the aforementioned horizontal plane. The connecting portion 1*a* is arranged to enter the case 6 through a first through hole 6*a* defined in the bottom surface of the case 6. In a case where the second swing arm 2 or the third swing arm 3 is provided, the first through hole 6*a* is closed with the first cover member 61 (see FIGS. 3 to 6).

To the upper end of the connecting portion 1*a* of the first swing arm 1, the first joint member 27 in the form of a shaft extending in the vertical direction is coaxially connected. The first joint member 27 includes a supporting shaft portion 27*a* extending in the vertical direction, a gear portion 27*b* provided on one-end side (upper side) of the supporting shaft portion 27*a* to mesh with the gear portion 26*e* of the first pivotally movable lever 26, and a connecting portion 27*c* provided on the other-end side (lower side) of the supporting shaft portion 27*a* to be connected to the connecting portion 1*a* of the first swing arm 1 via a spring 28 to be rotatable together as one unit. Because of the mesh of the gear portion 27*b* of the first joint member 27 and the gear portion 26*e* of the first pivotally movable lever 26, the first joint member 27 and the first swing arm 1 are rotated around the first axis Z1 as one unit by pivotal movement of the first pivotally movable lever 26.

On the front surface of the board 51, a first supporting table 53 is provided below the lever supporting shaft 52 to protrude forward. The front side surface (top end surface) of the first supporting table 53 is provided with a semicircular concave portion 53*a* which is arranged with its center above the first axis Z1 and provided to extend in the vertical direction. In the concave portion 53*a*, approximately a half in the circumferential direction of the supporting shaft portion 27*a* of the first joint member 27 is supported.

On both the right and left sides of the concave portion 53*a* on the top end surface of the first supporting table 53, the first cover member 29 is attached to the first supporting table 53 preferably by fasteners, such as, for example, screws 30 such that the first cover member 29 is detachable. The rear surface of the cover member 29 (i.e., the surface opposed to the top end surface of the first supporting table 53) is provided with a concave portion 29*a* which supports the remaining portion in the circumferential direction of the supporting shaft portion 27*a* therein. Thus, the supporting shaft portion 27*a* of the first joint member 27 is supported by the first supporting table 53 which corresponds to the first supporting portion to be rotatable around the first axis Z1. Also, the first swing arm 1 is supported by the board (the first supporting table) via the first joint member 27 to be capable of swinging (pivotally moving) around the first axis Z1. At the upper end of the first cover member 29, a fixing portion 29*b* is provided to be fixed to the top end of the lever supporting shaft 52 with a screw 31 to prevent the first pivotally movable lever 26 from being detached from the lever supporting shaft 52.

When the first pivotally movable lever 26 pivotally moves in the clockwise direction in FIG. 2, the first swing arm 1 pivotally moves around the first axis Z1 via the first joint member 27 to move the detection portion 1*b* to the left. On the other hand, when the first pivotally movable lever 26 pivotally moves in the counterclockwise direction in FIG. 2, the first swing arm 1 pivotally moves around the first axis Z1 to move the detection portion 1*b* to the right. In this manner, the first swing arm 1 swings (pivotally moves) around the first axis Z1 when the cam 25 rotates.

The supporting shaft portion 27*a* of the first joint member 27 has a larger-diameter portion 27*d* having a lager diameter than other portions arranged at an intermediate portion thereof in the axial direction to minimize vertical movement of the supporting shaft portion 27*a*. Also, the concave portion 53*a* of the first supporting table 53 includes a cut portion 53*b* defined therein to correspond to the larger-diameter portion 27*d*, and the concave portion 29*a* of the first cover member 29 includes a cut portion (not shown) provided therein to correspond to the larger-diameter portion 27*d*.

Between the supporting shaft portion 27*a* and the connecting portion 27*c* in the first joint member 27, a spring holding portion 27*e* is formed. To the spring holding portion 27*e*, one end of the first return spring 32 defined by an extension coil spring is attached. On the other hand, a first spring holding portion 57 is arranged on the right side of the spring holding portion 27*e* on the front surface of the board 51. The other end of the first return spring 32 is attached to the first spring holding portion 57. Because both ends of the first return spring 32 are attached to the spring holding portion 27*e* and the first spring holding portion 57, respectively, the first pivotally movable lever 26 is biased via the first joint member 27 in the counterclockwise direction in FIG. 2. Also, the first swing arm 1 is biased to move the detection portion 1*b* to the right.

When the first pivotally movable lever 26 is in the aforementioned initial state, the detection portion 1*b* of the first swing arm 1 projects from the right end of the ice tray 5 to the right and covers approximately a left half of the upper opening of the ice reservoir 21. Then, when the cam 25 rotates from the aforementioned initial rotational position in the clockwise direction and the first pivotally movable lever 26 pivotally moves in the clockwise direction, the detection portion 1*b* also moves to the left with this pivotal movement. At the time at which the first pivotally movable lever 26 has pivotally moved maximally from the initial state in the clockwise direction, the detection portion 1*b* is located approximately just below the ice tray 5. Then, when the cam 25 further rotates in the clockwise direction and the first pivotally movable lever 26 pivotally moves in the counterclockwise direction, the detection portion 1*b* moves to the right with this pivotal movement. When the cam 25 makes one revolution to return to the aforementioned initial rotational position, the first pivotally movable lever 26 returns to the above initial state and the detection portion 1*b* also returns to the original state.

In this arrangement, the cam 25 and the ice discharge levers 16 make two revolutions for each ice-discharge operation. During the first revolution of the cam 25 and the ice discharge levers 16, the first swing arm 1 makes one round trip. However, the detection portion 1*b* swings without being caught by any ice block 71 in the ice reservoir 21 because the ice blocks 71 are being removed from the ice tray 5. Then, during the second revolution of the cam 25 and the ice-discharge levers 16, the ice blocks 71 removed from the ice tray 5 as described before fall from the right end of the top plate 18 into the ice reservoir 21. At this time, the detection portion 1*b* of the first swing arm 1 has moved to the left and therefore does not disturb discharging the ice blocks. After the ice blocks 71 fell into the ice reservoir 21, the detection portion 1*b* of the first swing arm 1 moves to the right. Then, in a case where the ice blocks 71 in the ice reservoir 21 have reached an approximately full level because of falling of the ice blocks into the ice reservoir 21, the detection portion 1*b* which is forced to move to the right by the biasing force of the first return spring 32 is caught by any ice block 71, so that the detection portion 1*b* cannot move to the right only by the biasing force. That is, swinging of the first swing arm 1 is prevented when the ice level in the ice reservoir 21 is at or higher than the aforementioned predetermined level (i.e., the level close to the full level in this preferred embodiment). After that, even when the cam 25 continues to rotate, the first swing arm 1, the first joint member 27 and the first pivotally movable lever 26 cannot move and therefore stop. Therefore, even if the cam 25 returns to the aforementioned initial rotational position, the micro switch 65 is not switched from an OFF state to an ON state. From this, it is detected that the ice level in the ice reservoir 21 is at or higher than a predetermined level.

Thus, the motor 12, the driving gear 13, the driven gear 14, the cam 25, the first pivotally movable lever 26, the first joint member 27, the first swing arm 1, and the micro switch 65 define an ice level detection device arranged to detect that the ice level in the ice reservoir 21 is at or higher than a predetermined level. Also, the motor 12 defines an actuator arranged to drive the first swing arm 1 such that the swing arm 1 will swing, and the driving gear 13, the driven gear 14, the cam 25, the first pivotally movable lever 26, and the first joint member 27 define a transmission section arranged to transmit the movement of the actuator to the first swing arm 1.

At a time at which the ice blocks 71 are completely removed from the ice tray 5, the temperature of the ice tray 5 rises to a predetermined temperature, thereby a thermostat (not shown) is turned off. Thus, at that time a power supply to the heater is stopped and water is supplied from the water tank to the ice tray 5.

Then, the second revolution of the cam 25 is finished and ice is made in the ice tray 5 in which water has been supplied. When ice making is finished, the thermostat is turned on. If the micro switch 65 is in the ON state at this time, the motor 12 begins to be driven, thereby making the cam 25 make two revolutions again.

On the other hand, even when the thermostat is turned on, driving of the motor 12 does not start while the micro switch 65 is in OFF state. That is, discharge of ice blocks does not occur. Then, when the ice blocks 71 have been removed from the ice reservoir 21 and the ice level has reached a level lower than the aforementioned predetermined level, the first pivotally movable lever 26 returns to the initial position by the biasing force of the first return spring 32, thereby turning on the micro switch 65. In this manner, the cam 25 makes two revolutions again.

On the front surface of the board 51, a second supporting table 54 as a second supporting portion arranged to support the second joint member 36 which is described later and is to be connected to the second swing arm 2 as described later is provided on the right side of the lever supporting shaft 52. The second supporting table 54 is used in a case where the second swing arm 2 is provided in place of the first swing arm 1. Therefore, in a case where the first swing arm 1 is provided, the second joint member 36 is not supported by the second supporting table 54.

Moreover, a tube-shaped supporting portion 55 as a third supporting portion arranged to support the third joint member 44 which is described later and is connected to the third swing arm 3 as described later is provided on the front surface of the board 51 near the upper right corner thereof. The tube-shaped supporting portion 55 is used in a case where the third swing arm 3 is provided. In a case where the first swing arm 1 is provided, the third joint member 44 is not supported by the tube-shaped supporting portion 55.

As described above, the first, second, and third supporting portions (the first supporting table 53, the second supporting table 54, and the tube-shaped supporting portion 55) arranged to support the first, second, and third joint members 27, 36, and 44, respectively, are provided at positions on the board 51 which are different from one another.

Figure 3:
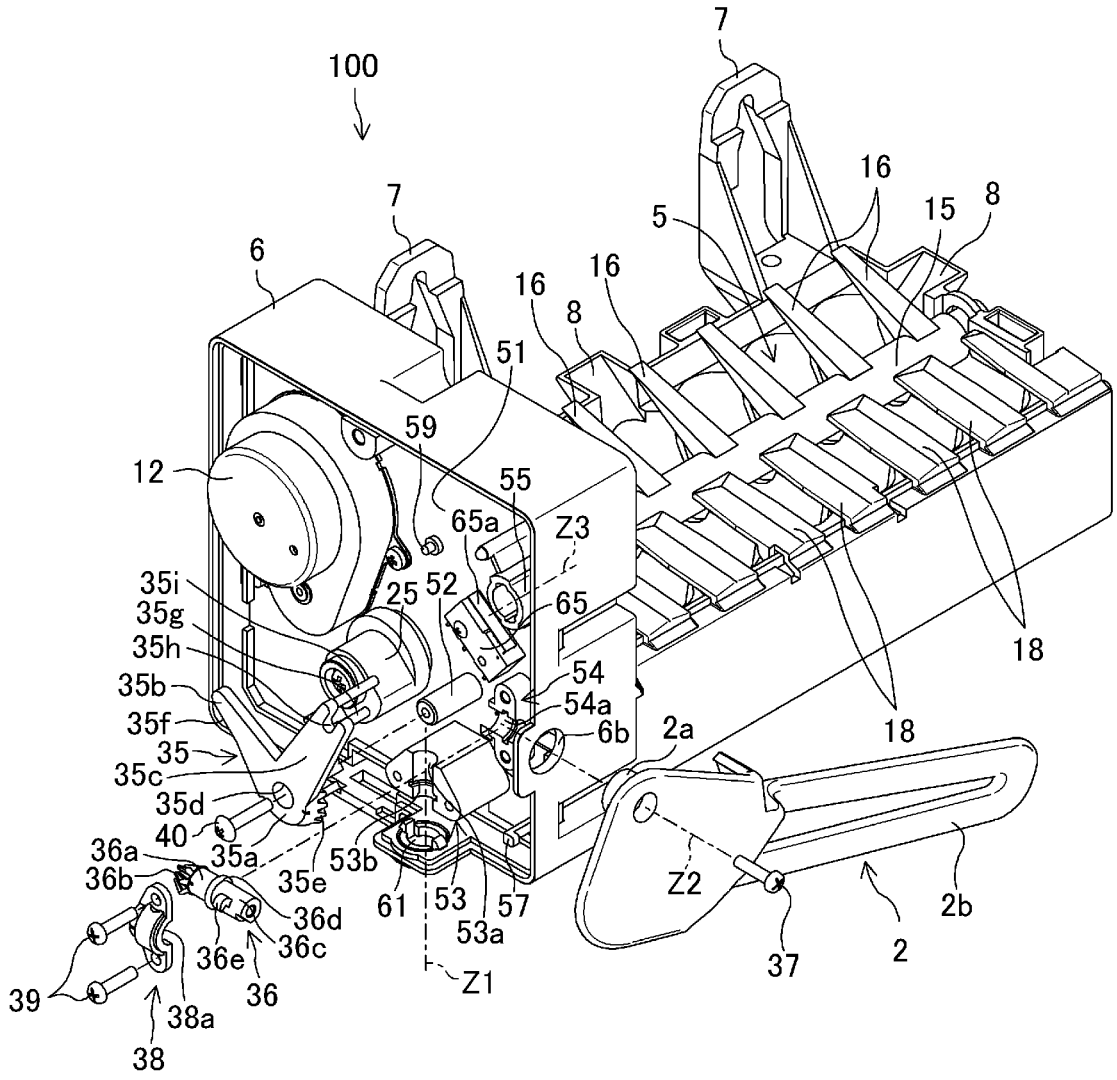
FIG. 3 is a perspective view of the automatic icemaker according to a preferred embodiment of the present invention, in which a second swing arm is provided.
Figure 4:
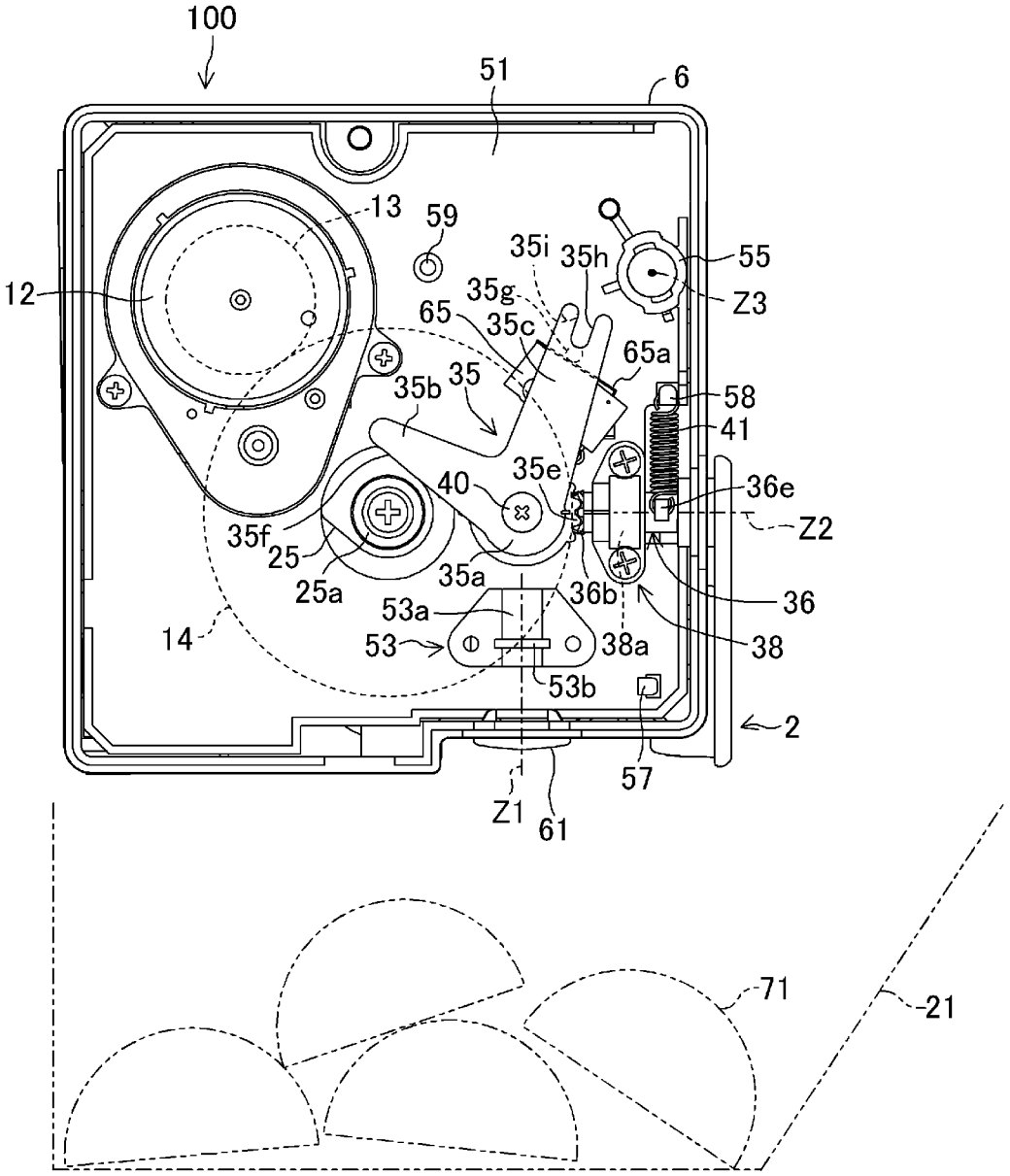
FIG. 4 shows the inside of the case of the automatic icemaker of FIG. 3.

FIGS. 3 and 4 show the case where the second swing arm 2 is provided in place of the first swing arm 1 in the automatic icemaker 100. In this case, in place of the first pivotally movable lever 26, a second pivotally movable lever 35 is supported by the lever supporting shaft 52 of the board 51 to be pivotally movable. The second pivotally movable lever 35 includes a tube-shaped supporting portion 35*a* extending in the back-front direction, provided with a fitting hole 35*d* into which the lever supporting shaft 52 is to be fitted, and first and second extending portions 35*b* and 35*c* radially extending from the front end of the supporting portion 35*a* approximately along the front surface of the board 51, like the first pivotally movable lever 26. The extending direction of the first and second extending portions 35*b* and 35*c* are the same as those similar thereto in the first pivotally movable lever 26. A gear portion 35*e* is provided in a portion (near the second extending portion 35*c*) of the circumference of the front end of the supporting portion 35*a*.

As in the first pivotally movable lever 26, the side surface of the first extending portion 35*b* on the cam 25 side serves as an abutting portion 35*f* arranged to abut the cam 25. On the rear surface of the second extending portion 35*c*, a pin-shaped switch operating portion 35*g* arranged to activate the micro switch 65 is provided near the top end of the second extending portion 35*c* to project backward. While the second pivotally movable lever 35 is in an initial state (i.e., the state shown in FIG. 4), the switch piece 65*a* of the micro switch 65 is pressed by the switch operating portion 35*g* and therefore the micro switch 65 is in ON state.

The second pivotally movable lever 35 uses the same components as the third pivotally movable lever (described later) in a case where the third swing arm 3 is provided. Thus, at the top end of the second extending portion 35*c*, an engagement portion 35*h* (defined by a cut portion in this preferred embodiment) is provided to engage with the third joint member 44 (used in the case where the third swing arm 3 is provided). Moreover, on the rear surface of the top end of the second extending portion 35*c*, a spring holding portion 35*i* to which one end of a third return spring 45 (used in the case where the third swing arm 3 is provided) is attached is provided to project backward.

The operation of the second pivotally movable lever 35 and the times at which the micro switch 65 is turned on and off are the same in the case of providing the first pivotally movable lever 26. The pivotal movement of the second pivotally movable lever 35 is transmitted to the second swing arm 2 via the second joint member 36.

The second swing arm 2 (a detection portion 2*b* described later) is arranged to swing in a vertical plane which is located on the right at a position outside of the ice tray 5 and passes through the ice reservoir 21, around a horizontal second axis Z2 approximately along the front surface of the board 51 (i.e., the second axis Z2 extending in the right-left direction). The second swing arm 2 includes a connecting portion 2*a* which is arranged with the second axis Z2 as the center of its swing and is arranged to be connected to the second joint member 36, and a detection portion 2*b* in the shape of a flat plate which is fixed to the right end of the connecting portion 2*a* and extends backward from the connecting portion 2*a*. The detection portion 2*b* extends in the back-front direction and vertical direction in the aforementioned vertical plane.

The connecting portion 2*a* of the second swing arm 2 is arranged to extend through a second through hole 6*b* defined in the right side surface of the case 6 and enter the case 6. The second through hole 6*b* is closed with a second cover member 62 in a case where the first swing arm 1 or the third swing arm 3 is provided (see FIGS. 1, 2, 5, 6, and 7).

To the left end of the connecting portion 2*a*, the second joint member 36 in the shape of a shaft extending in the right-left direction is connected coaxially. The second joint member 36 preferably includes a supporting shaft portion 36*a* extending in the right-left direction, a gear portion 36*b* which is provided on one-end side (left side) of the supporting shaft portion 36*a* and is arranged to mesh together with the gear portion 35*e* of the second pivotally movable lever 35, and a connecting portion 36*c* which is provided on the other-end side (right side) of the supporting shaft portion 36*a* and is to be connected to the connecting portion 2*a* of the second swing arm 2 preferably via a fastener, such as, for example, a screw 37 to be rotatable together as one unit. Because of the meshing together of the gear portion 36*b* of the second joint member 36 and the gear portion 35*e* of the second pivotally movable lever 35, the second joint member 36 and the second swing arm 2 can be rotated together as one unit around the second axis Z2 by pivotal movement of the second pivotally movable lever 35.

The second joint member 36 is arranged to be supported by the second supporting table 54. The second supporting table 54 is also provided on the front surface of the board 51 to project forward, like the first supporting table 53. The front surface (top end surface) of the second supporting table 54 has a semicircular concave portion 54*a* defined therein around the second axis Z2 as the center and extending in the right-left direction. The concave portion 54*a* is arranged to support approximately a half in the circumferential direction of the supporting shaft portion 36*a* of the second joint member 36.

Both on the upper and lower sides of the concave portion 54*a* on the top end surface of the second supporting table 54, a second cover member 38 is attached to the top end surface of the second supporting table 54 with screws 39 to be detachable. The second cover member 38 includes a concave portion 38*a* arranged in the rear surface thereof (i.e., the surface opposed to the top end surface of the second supporting table 54) to support the remaining portion in the circumferential direction of the supporting shaft portion 36*a*. In this manner, the supporting shaft portion 36*a* of the second joint member 36 is supported by the second supporting table 54 corresponding to the second supporting portion to be rotatable around the second axis Z2. Moreover, the second swing arm 2 is supported by the board 51 (the second supporting table 54) via the second joint member 36 around the second axis Z2 to be capable of swinging (pivotally moving). Please note that the second cover member 38 is not provided with a portion corresponding to the fixed portion 29*b* which is to be fixed to the top end of the lever supporting shaft 52, unlike the first cover member 29. The second pivotally movable lever 35 is arranged so that a screw 40 to be threadably mounted on the top end of the lever supporting shaft 52 prevents the second pivotally movable lever 35 from falling off from the lever supporting shaft 52.

When the second pivotally movable lever 35 pivotally moves in the clockwise direction in FIG. 4, the second swing arm 2 pivotally moves around the second axis Z2 via the second joint member 36 so that the detection portion 2*b* moves upward. On the other hand, when the second pivotally movable lever 35 pivotally moves in the counterclockwise direction in FIG. 4, the second swing arm 2 pivotally moves around the second axis Z2 so that the detection portion 2*b* moves downward. In this manner, the rotation of the cam 25 makes the second swing arm 2 swing (pivotally move) around the second axis Z2.

The supporting shaft portion 36*a* of the second joint member 36 has a larger-diameter portion 36*d* arranged at an axially intermediate position to minimize the movement in the right-left direction of the supporting shaft portion 36*a*. Also, in the concave portion 54*a* of the second supporting table 54, a cut portion 54*b* is arranged to correspond to the larger-diameter portion 36*d* (see FIGS. 2 and 6). Furthermore, also in the concave portion 38*a* of the second cover member 38, a cut portion (not shown) is arranged to correspond to the larger-diameter portion 36*d*.

Between the supporting shaft portion 36*a* and the connecting portion 36*c* of the second joint member 36, a spring holding portion 36*e* is arranged so that one end of the second return spring 41 defined by the same extension coil spring as the first return spring 32 is attached to the spring holding portion 36*e*. On the other hand, on the front surface of the board 51 above the spring holding portion 36*e*, a second spring holding portion 58 is arranged so that the other end of the second return spring 41 is attached thereto. Because both the ends of the second return spring 41 are attached to the spring holding portions 36*e* and 58, the second pivotally movable lever 35 is biased in the counterclockwise direction in FIG. 4 via the second joint member 36. Also, the second swing arm 2 is biased so that the detection portion 2*b* moves downward.

In this preferred embodiment, the second joint member 36 has a shape similar to that of the first joint member 27, but is different from that in the length of the supporting shaft portion 36*a*, the length of the connecting portion 36*c*, the maximum diameter of the gear portion 36*b*, and the shape of the spring holding portion 36*e*, for example.

In a case where the second swing arm 2 is provided in place of the first swing arm 1 in the aforementioned manner, the first joint member 27 is not supported by the first supporting table 53. Also, the first cover member 29 is not attached. Moreover, the third joint member 44 is not supported by the tube-shaped supporting portion 55.

While the second pivotally movable lever 35 is in the initial state, the detection portion 2*b* of the second swing arm 2 projects from the bottom surface of the ice tray 5 downward and is located in the upper portion of the inside of the ice reservoir 21. When the cam 25 rotates from the initial rotational position shown in FIG. 4 in the clockwise direction and the second pivotally movable lever 35 pivotally moves from the aforementioned initial state in the clockwise direction, the detection portion 2*b* moves upward with that pivotal movement. At the time at which the second pivotally movable lever 35 has pivotally moved from the initial state in the clockwise direction maximally, the detection portion 2*b* is located approximately just beside the ice tray 5 (i.e., outside the ice reservoir 21). Thereafter when the cam 25 further rotates in the clockwise direction and the second pivotally movable lever 35 pivotally moves in the counterclockwise direction, the detection portion 2*b* moves downward with that pivotal movement. When the cam 25 makes one revolution to return to the initial rotational position in the above-described manner, the second pivotally movable lever 35 returns to the initial state and the detection portion 2*b* returns to the original state.

As described above, in the case where the second swing arm 2 is provided, the second pivotally movable lever 35, the second joint member 36, and the second swing arm 2 define the ice-level detection device in place of the first pivotally movable lever 26, the first joint member 27, and the first swing arm 1. In this case, the operations of the motor 12, the cam 25, the second pivotally movable lever 35, the ice discharge lever shaft 15, and the ice discharge levers 16 are the same as or similar to those in the case where the first swing arm 1 is provided.

When the ice reservoir 21 is approximately full with the ice blocks 71 because of falling of the ice blocks 71 into the ice reservoir 21 caused by the second revolution of the cam 25 and the ice discharge levers 16, the detection portion 2*b* which is forced to move downward by the biasing force of the second return spring 41 is caught by any of the ice blocks 71, and therefore cannot move downward only by the biasing force. In other words, the swing movement of the second swing arm 2 is prevented when the ice level in the ice reservoir 21 is at the aforementioned predetermined level (the level close to the full level in this preferred embodiment) or higher. In this state, even if the cam 25 continues to rotate, the second swing arm 2, the second joint member 36, and the second pivotally movable lever 35 cannot move, i.e., stop. Thus, even if the cam 25 returns to the aforementioned initial rotational position, the micro switch 65 cannot be switched from an OFF state to an ON state. From this, it is detected that the ice level in the ice reservoir 21 is at the predetermined level or higher.

Figure 5:
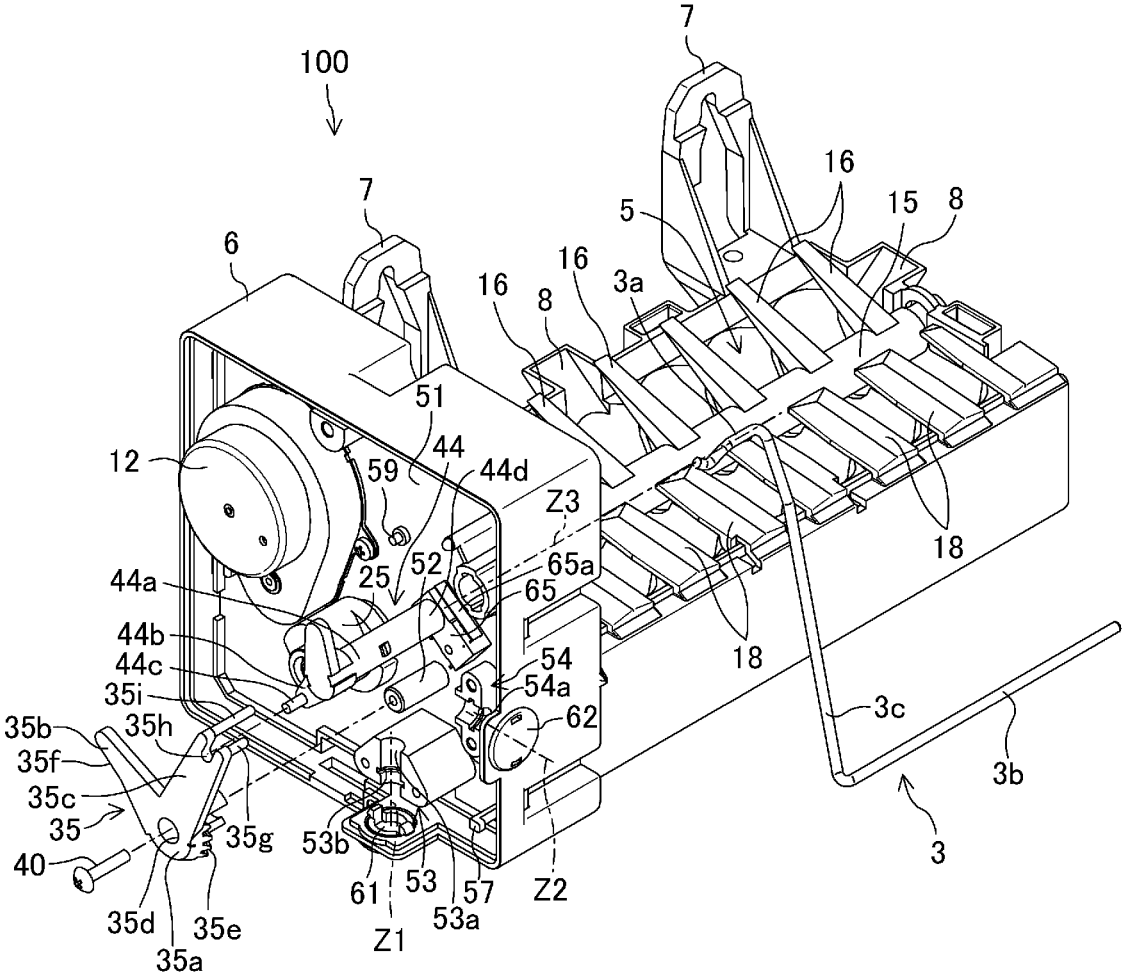
FIG. 5 is a perspective view of the automatic icemaker according to a preferred embodiment of the present invention, in which a third swing arm is provided.
Figure 6:
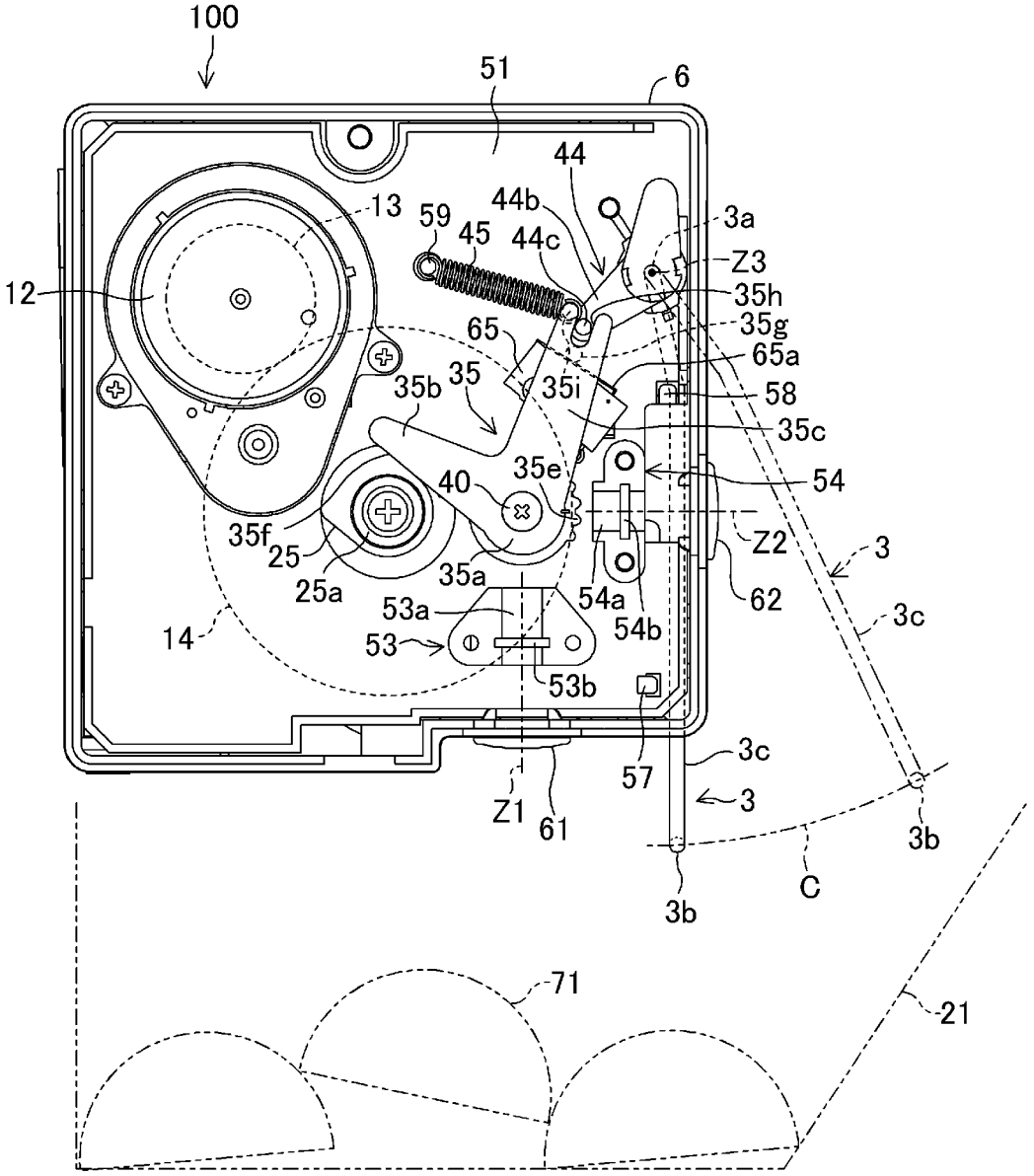
FIG. 6 shows the inside of the case of the automatic icemaker of FIG. 5.
Figure 7:
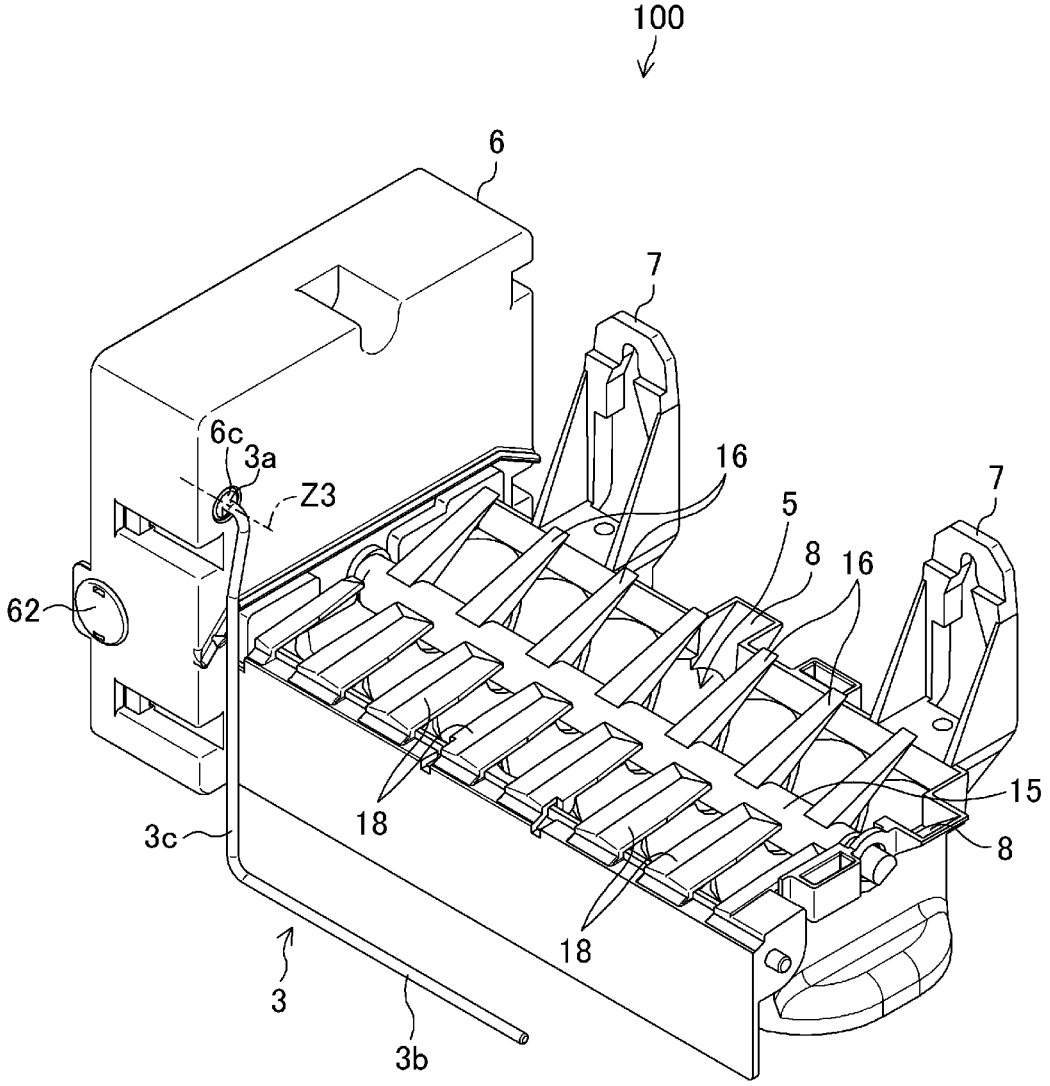
FIG. 7 is a perspective view of the automatic icemaker of FIG. 5, seen from a different direction.

FIGS. 5 to 7 show the case where the third swing arm 3 is provided in the automatic icemaker 100 in place of the first swing arm 1 or the second swing arm 2. In this case, a third pivotally movable lever is supported by the lever supporting shaft 52 of the board 51 to be pivotally movable. In this preferred embodiment, the third pivotally movable lever is defined by the same components as the components of the second pivotally movable lever 35. Therefore, the following description is made assuming that the second pivotally movable lever 35 is used (FIGS. 5 to 7 are drawn based on the same assumption.)

The pivotal movement of the second pivotally movable lever 35 is transmitted to the third swing arm 3 via a third joint member 44. The third swing arm 3 (a detection portion 3*b* described later) is arranged to swing along a cylindrical surface C (see FIG. 6) which has the center on a horizontal third axis Z3 perpendicular or approximately perpendicular to the front surface of the board 51 (i.e., the third axis Z3 extending in the back-front direction), and is arranged outside the ice tray 5 and inside the ice reservoir 21 around the third axis Z3. The third swing arm 3 is defined by a rod-shaped member and includes a swing center portion 3*a* extending from the rear surface of the case 6 backward on the third axis Z3, a detection portion 3*b* extending in the back-front direction parallel or approximately parallel to the third axis Z3 at a level lower than the swing center portion 3*a*, and a connector portion 3*c* connecting the rear end of the swing center portion 3*a* and the front end of the detection portion 3*b* to each other.

The swing center portion 3*a* is arranged to extend through a third through hole 6*c* (see FIG. 7) defined in the rear surface of the case 6 and enter the inside of the case 6. The third through hole 6*c* is closed with a third cover member (not shown) in the case where the first swing arm 1 or the second swing arm 2 is provided.

To the front end of the swing center portion 3*a*, the third joint member 44 is connected. The third joint member 44 includes a supporting shaft portion 44*a* extending in the back-front direction, an extending portion 44*b* which extends from the front end of the supporting shaft portion 44*a* approximately along the front surface of the board 51 and includes an engagement portion 44*c* (defined by a pin, for example) at its top end to engage with the second pivotally movable lever 35, and a connecting portion 44*d* which is provided at the rear end of the supporting shaft portion 44*a* to be connected to the front end of the swing center portion 3*a* of the third swing arm 3 to be rotatable together as one unit.

The supporting shaft portion 44*a* is fitted into the tube-shaped supporting portion 55. The center axis of the tube-shaped supporting portion 55, i.e., the center axis of the supporting shaft portion 44*a*, is substantially coincident with the third axis Z3. Therefore, the third joint member 44 is supported to be rotatable around the third axis Z3. Moreover, the third swing arm 3 is supported by the board 51 (tube-shaped supporting portion 55) via the third joint member 44 to be capable of swinging (pivotally moving) around the third axis Z3.

As described before, the top end of the second extending portion 35*c* of the second pivotally movable lever 35 is provided with the engagement portion 35*h* defined by a cut portion, and the engagement portion 35*h* (cut portion) of the second pivotally movable lever 35 and the engagement portion 44 (pin) of the third joint member 44 engage with each other. Thus, when the second pivotally movable member 35 pivotally moves in the clockwise direction in FIG. 6, the third joint member 44 pivotally moves around the third axis Z3 in the counterclockwise direction in FIG. 6. With this pivotal movement of the third joint member 44, the third swing arm 3 also pivotally moves around the third axis Z3 in the counterclockwise direction in FIG. 6. On the other hand, when the second pivotally movable lever 35 pivotally moves in the counterclockwise direction in FIG. 6, the third joint member 44 and the third swing arm 3 pivotally move around the third axis Z3 in the clockwise direction in FIG. 6. In this manner, rotation of the cam 25 makes the third swing arm 3 swing (pivotally move) around the third axis Z3.

Moreover, the top end of the rear surface of the second extending portion 35*c* of the second pivotally movable lever 35 is provided with the spring holding portion 35*i* to which one end of a third return spring 45 is to be attached, as described before. The third return spring 45 is provided by an extension coil spring which is the same as the first return spring 32, like the second return spring 41. On the other hand, a third spring holding portion 59 to which the other end of the third return spring 45 is to be attached is provided on the upper left side of the spring holding portion 35*i* on the front surface of the board 51. Because of the third return spring 45 with both ends attached to the spring holding portions 35*i* and 59, respectively, the second pivotally movable lever 35 is biased in the counterclockwise direction in FIG. 6. Thus, the third swing arm 3 is biased in the clockwise direction in FIG. 6. Please note that at least one of the first return spring 32, the second return spring 41, and the third return spring 45 can be provided by a spring (component) different from that defining the other return spring, but it is preferable that the first, second, and third return springs 32, 41, and 45 be provided by the same springs in view of sharing components.

In the case where the third swing arm 3 is provided, the first joint member 27 is not supported by the first supporting table 53. Also, the first cover member 29 is not attached to the first supporting table 53. Moreover, the second joint member 36 is not supported by the second supporting table 54, nor the second cover member 38 is not attached thereto.

While the second pivotally movable lever 35 is in the aforementioned initial state, the detection portion 3*b* of the third swing arm 3 is located in the upper portion of the inside of the ice reservoir 21. When the cam 25 rotates from an initial rotational position shown in FIG. 6 in the clockwise direction and the second pivotally movable lever 35 pivotally moves from the initial state in the clockwise direction, the detection portion 3*b* moves upward and to the right along the cylindrical surface C having the third axis Z3 as its center on with this pivotal movement. At the time at which the second pivotally movable lever 35 has pivotally moved from the initial state in the clockwise direction maximally, the detection portion 3*b* is located outside the ice reservoir 21 (see the state shown with two-dot chain line in FIG. 6). Then when the cam 25 further rotates in the clockwise direction and the second pivotally movable lever 35 pivotally moves in the counterclockwise direction, the detection portion 3*b* moves downward and to the left with that pivotal movement. When the cam 25 makes one revolution in the above-described manner to return the initial rotational position, the second pivotally movable lever 35 returns to the aforementioned initial state and the detection portion 3*b* returns to the original state.

As described above, in the case where the third swing arm 3 is provided, the second pivotally movable lever 35, the third joint member 44, and the third swing arm 3 define the ice-level detection device in place of the first pivotally movable lever 26, the first joint member 27 and the first swing arm 1. In this case, the operations of the motor 12, the cam 25, the second pivotally movable lever 35, the ice discharge lever shaft 15, and the ice discharge levers 16 are the same as those in the case where the first swing arm 1 or the second swing arm 2 is provided.

In this arrangement, when the ice reservoir 21 is approximately full with the ice blocks 71 because of falling of the ice blocks 71 into the ice reservoir 21 caused by the second revolution of the cam 25 and the ice discharge levers 16, the detection portion 3*b* which is forced to move downward and to the left by the biasing force of the third return spring 45 is caught by the ice block 71 and cannot move only by that biasing force. In other words, when the ice level in the ice reservoir 21 is at the aforementioned predetermined level (the level closer to the full level in this preferred embodiment) or higher, swing movement of the third swing arm 3 is prevented. In this state, even if the cam 25 continues to rotate, the third swing arm 3, the third joint member 44, and the second pivotally movable lever 35 cannot move, i.e., they stop. Therefore, even if the cam 25 returns to the aforementioned initial rotational position, the micro switch cannot be switched from an OFF state to an ON state. From this, it is detected that the ice level in the ice reservoir 21 is at the predetermined level or higher.

Therefore, according to the present preferred embodiment of the present invention, it is only necessary to change the joint member (the first, second, and third joint members 27, 36, and 44) to correspond to a selected one of the first, second, and third swing arms 1, 2, and 3. In this preferred embodiment, the change between the first swing arm 1 and the second swing arm 2 requires the change between the first pivotally movable member 26 and the second pivotally movable member 35 and the change between the first cover member 29 and the second cover member 38, but other components are shared. Moreover, because the board 51 is provided with the first, second, and third supporting portions (the first supporting table 53, the second supporting table 54, and the tube-shape supporting portion 55) provided to support the first, second, and third joint members 27, 36, and 44, respectively, it is only necessary to arrange the joint member corresponding to the selected one of the swing arms so that it is supported by the corresponding one of the supporting portions. In this manner, many components can be shared among three ice-level detection methods, and therefore the component cost can be reduced and it is possible to promptly manufacture the ice-level detection device corresponding to any ice-level detection method.

The present invention is not limited to the above preferred embodiments, but can be modified without departing from the scope of the claims.

For example, in the above preferred embodiments, the third pivotally movable lever used in the case where the third swing arm is provided is defined by the same components as the second pivotally movable lever. However, it is possible to provide the third pivotally movable lever with the same components as the first pivotally movable lever 26. Moreover, in the above preferred embodiment the first pivotally movable lever 26 and the second pivotally movable lever 35 are defined by the different components from each other. This is because there is restriction on the size of the case 6 because of the space and therefore the gear portion 26*e* of the first joint member 26 is different from the gear portion 35*e* of the second joint member 35 in the position in the back-front direction. However, if there is no such restriction, the first and second pivotally movable levers 26 and 35 (and the third pivotally movable lever) can share the same components. In this case, for example, a gear portion is provided in approximately the entire portion of the circumferential edge of the front end of the supporting portion 26*a* of the first pivotally movable lever 26, except for the portion in which the first and second extending portions 26*b* and 26*c* are provided, so that this portion can engage with the gear portions 27*b* and 36*b* of the first and second joint members 27 and 36.

Although the first joint member 27 and the second joint member 36 are provided by different components from each other in the above preferred embodiments, it is preferable to define the first joint member 27 and the second joint member 36 from the same components. Especially, if the first pivotally movable lever 26 and the second pivotally movable lever 35 are provided by the same components as described above, it is easy to define the first joint member 27 and the second joint member 36 from the same components.

In addition, in a case where the first joint member 27 and the second joint member 36 are defined by the same components, it is preferable to provide the first cover member 29 and the second cover member 38 from the same components. In this case, the second cover member 38 may be provided with a fixing portion which is the same as or similar to the fixing portion 29*b* fixed to the top end of the lever supporting shaft 52 as in the first cover member 29.

Furthermore, the ice-discharge device is arranged to scrape out the ice blocks 71 in the ice tray through use of the ice-discharge levers in the above preferred embodiment. However, the ice-discharge device may be arranged so that, by reversing the ice tray, the ice blocks 71 in the ice tray are made to free fall.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An automatic icemaker comprising:

an ice tray configured to be supplied with water and to make ice;

an ice discharge device configured to make the ice made by the ice tray fall off into an ice reservoir positioned below the ice tray; and an ice-level detection device configured to detect that an ice level in the ice reservoir is at a predetermined level or higher; wherein a board, extending in a first direction, is provided on an outer side surface of the ice tray;

the ice-level detection device includes:

one of a first swing arm, a second swing arm, and a third swing arm supported by the board so as to be swingable and configured to not swing when the ice level in the ice reservoir is at the predetermined level or higher;

an actuator configured to be supported by the board and to drive the one of the first swing arm, the second swing arm, and the third swing arm such that the one of the first swing arm, the second swing arm, and the third swing arm will swing; and a transmission section configured to be supported by the board and to transmit movement of the actuator to the one of the first swing arm, the second swing arm, and the third swing arm; wherein the transmission section includes a cam configured to be rotated by the actuator, a pivotally movable lever including an abutting portion configured to abut the cam and to be pivotally moved by rotation of the cam, and one of a first joint shaft, a second joint shaft, and a third joint shaft, the first joint shaft, the second joint shaft, and the third joint shaft being configured to respectively connect the one of the first swing arm, the second swing arm, and the third swing arm and configured to transmit pivotal movement of the pivotally movable lever to the one of the first swing arm, the second swing arm, and the third swing arm; and all of a first supporting portion, a second supporting portion, and a third supporting portion are provided at positions on the board that are different from one another and are respectively configured to support the first joint shaft, the second joint shaft, and the third joint shaft;

the first swing arm is configured to swing in a first plane passing between the ice tray and the ice reservoir around a first axis;

the second swing arm is configured to swing in a second plane, perpendicular or substantially perpendicular to the first plane, passing outside of the ice tray and inside the ice reservoir, around a second axis which extends approximately along a surface of the board; and the third swing arm is configured to swing around a third axis, with a portion of the third swing arm swinging in a plane approximately parallel to the surface of the board along a cylindrical surface which passes outside the ice tray and inside the ice reservoir and is positioned around the third axis; and each of the first swing arm, the second swing arm, and the third swing arm is respectively configured to be supported by the board via the first joint shaft, the second joint shaft, and the third joint shaft with only one of the first swing arm, the second swing arm, and the third swing arm being installed at a time.

2. An automatic icemaker according to claim 1, wherein the pivotally movable lever further includes a gear portion; the first joint shaft includes:

a first supporting shaft portion configured to be supported by the first supporting portion to be rotatable around the first axis;

a first gear portion located on one-end side of the first supporting shaft portion to mesh together with the gear portion of the pivotally movable lever; and a first connecting portion located on the other-end side of the first supporting shaft portion to be connected to the first swing arm; wherein the first supporting portion is defined by a first supporting table provided on the board to support approximately half of the first supporting shaft portion of the first joint shaft;

the first supporting table is provided with a first cover member configured to support a remaining portion of the first supporting shaft portion of the first joint shaft, the first cover member being detachable;

the second joint shaft includes:

a second supporting shaft portion configured to be supported by the second supporting portion to be rotatable around the second axis;

a second gear portion located on one-end side of the second supporting shaft portion to mesh together with the gear portion of the pivotally movable lever; and a second connecting portion located on the other-end side of the second supporting shaft portion to be connected to the second swing arm; wherein the second supporting portion is defined by a second supporting table provided in the board to support approximately half of the second supporting shaft portion of the second joint shaft; and the second supporting table is provided with a second cover member configured to support a remaining portion of the second supporting shaft portion, the second cover member being attached in a detachable manner.

3. An automatic icemaker according to claim 2, wherein the first joint shaft and the second joint shaft are defined by the same components.

4. An automatic icemaker according to claim 2, wherein the third joint shaft includes a third supporting shaft portion configured to be supported by the third supporting portion to be rotatable around the third axis, an extending portion extending from an end of the third supporting portion approximately along the surface of the board and including an engagement portion defined at its end to engage with the pivotally movable lever, and a connecting portion defined at another end of the third supporting shaft portion to be connected to the third swing arm;

the pivotally movable lever further includes a further engagement portion with which the engagement portion of the third joint shaft is to engage to allow the third joint shaft to be rotated around the third axis by rotation of the pivotally movable lever; and the third supporting portion is defined by a tube-shaped supporting portion provided on the board into which the third supporting shaft portion is fitted.

* * * * *